US009718274B2

(12) United States Patent
Inada et al.

(10) Patent No.: US 9,718,274 B2
(45) Date of Patent: Aug. 1, 2017

(54) LIQUID EJECTION HEAD AND LIQUID EJECTION APPARATUS

(71) Applicant: CANON KABUSHIKI KAISHA, Tokyo (JP)

(72) Inventors: Genji Inada, Koshigaya (JP); Hiromasa Amma, Kawasaki (JP); Takuya Iwano, Inagi (JP); Chiaki Muraoka, Kawaguchi (JP); Tokuji Kudo, Kawasaki (JP); Shimpei Yoshikawa, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/151,964

(22) Filed: May 11, 2016

(65) Prior Publication Data

US 2016/0339697 A1 Nov. 24, 2016

(30) Foreign Application Priority Data

May 22, 2015 (JP) ..... 2015-104847

(51) Int. Cl.

| | |
|---|---|
| ***B41J 2/175*** | (2006.01) |
| ***B41J 29/02*** | (2006.01) |
| ***B41J 2/14*** | (2006.01) |

(52) U.S. Cl.

CPC ..... *B41J 2/175* (2013.01); *B41J 2/14145* (2013.01); *B41J 2/17509* (2013.01); *B41J 2/17513* (2013.01); *B41J 2/17523* (2013.01); *B41J 2/17553* (2013.01); *B41J 2/17563* (2013.01); *B41J 29/02* (2013.01); *B41J 2202/07* (2013.01)

(58) Field of Classification Search

CPC .... B41J 2/175; B41J 2/17523; B41J 2/17513; B41J 2/17563; B41J 2202/07

See application file for complete search history.

(56) References Cited

U.S. PATENT DOCUMENTS

| | | | |
|---|---|---|---|
| 6,095,639 | A | 8/2000 | Uetsuki et al. |
| 6,467,882 | B2 | 10/2002 | Inui et al. |
| 6,540,343 | B1 | 4/2003 | Umeyama et al. |
| 6,805,437 | B2 | 10/2004 | Yamanaka et al. |
| 8,087,759 | B2 | 1/2012 | Oikawa et al. |
| 8,210,655 | B2 | 7/2012 | Muraoka et al. |
| 8,998,375 | B2 | 4/2015 | Amma et al. |
| 9,248,650 | B2 | 2/2016 | Muraoka et al. |
| 2002/0130935 | A1* | 9/2002 | Liu ..... B41J 2/14145 347/93 |

FOREIGN PATENT DOCUMENTS

JP 2002-307709 A 10/2002

OTHER PUBLICATIONS

U.S. Appl. No. 15/155,630, Hiromasa Amma, Mikiya Umeyama, Genji Inada, Takuya Iwano, Yasuyuki Takanaka, Masaya Uetsuki, filed May 16, 2016.

U.S. Appl. No. 15/160,167, Genji Inada, Hiromasa Amma, Takuya Iwano, Chiaki Muraoka, Tokuji Kudo, Shimpei, Yoshikawa, Monta Matsui, filed May 20, 2016.

* cited by examiner

*Primary Examiner* — Geoffrey Mruk

(74) *Attorney, Agent, or Firm* — Fitzpatrick, Cella, Harper & Scinto

(57) ABSTRACT

In a liquid ejection head and a liquid ejection apparatus capable of reducing the occurrence of ejection malfunction, in a connecting section where a first flow channel and a second flow channel connect, a projecting member is provided on the flow channel wall forming the second flow channel.

12 Claims, 11 Drawing Sheets

LIQUID EJECTION HEAD AND LIQUID EJECTION APPARATUS

BACKGROUND OF THE INVENTION

Field of the Invention

The present invention relates to a liquid ejection head used in a liquid ejection apparatus, and to a liquid ejection apparatus.

Description of the Related Art

The liquid supply system typically used in a liquid ejection apparatus is equipped with a main tank that stores liquid internally, a supply unit to which the main tank is removably attached, and a liquid ejection head connected to the supply unit through a supply tube. The liquid ejection head is equipped with a sub-tank section connected to the supply tube, a filter, a liquid chamber connected to the sub-tank section through the filter, an ejection element board that ejects liquid, and a flow channel that connects the liquid chamber and the ejection element board.

Liquid supplied from the supply tube first enters the sub-tank section, passes through the filter to reach the liquid chamber, and after that, passes through the flow channel to be ejected from the ejection element board. In such a liquid ejection head, bubbles containing gas dissolved in the liquid readily accumulate on the downstream side of the filter. If the bubbles adhere to the filter on the downstream side of the filter, the supply of liquid may be blocked in that portion.

Accordingly, Japanese Patent Laid-Open No. 2002-307709 discloses technology in which a partition section provided with ribs is provided inside the liquid ejection head. By supporting the filter with the partition section, and causing the filter and the ribs to abut, the supply of liquid is ensured.

In the configuration of Japanese Patent Laid-Open No. 2002-307709, depending on the temperature and the pressure of the liquid inside the liquid chamber, bubbles are produced, such as dissolved gas bubbles precipitated from the liquid inside the liquid chamber, and bubbles sucked inside from the ejection ports during the ejection of liquid droplets (ejection bubbles). Bubbles accumulate at the top inside the liquid chamber due to buoyancy of the bubbles themselves, but as the flow rate of liquid increases, such as during high-speed printing, the bubbles overcome buoyancy to move into the flow channel on the downstream side together with the liquid and reach the ejection element board, thereby creating a risk of ejection malfunction.

SUMMARY OF THE INVENTION

Accordingly, the present invention provides a liquid ejection head and a liquid ejection apparatus capable of reducing the occurrence of ejection malfunction.

A liquid ejection head according to the present invention is a liquid ejection head including an ejection element board that ejects liquid, wherein a flow channel that guides liquid to the ejection element board includes a first flow channel of wide cross-sectional area, and a second flow channel of narrow cross-sectional area, connected to the first flow channel and downstream to the first flow channel. The liquid ejection head includes at least one projecting member projecting out into the flow channel from a flow channel wall forming the second flow channel.

According to the present invention, a liquid ejection head and a liquid ejection apparatus capable of reducing the occurrence of ejection malfunction may be realized.

Further features of the present invention will become apparent from the following description of exemplary embodiments (with reference to the attached drawings).

DESCRIPTION OF THE EMBODIMENTS

First Embodiment

Hereinafter, a first embodiment of the present invention will be described with reference to the drawings. Note that in the present embodiment, a connecting section of the flow channel having a different cross-sectional area, such as a curved section, is designated the irregular flow channel connecting section, while the flow channel on the upstream side of the irregular flow channel connecting section is designated the first flow channel, and the flow channel on the downstream side of the flow channel connecting section, having a smaller cross-sectional area than the first flow channel, is designated the second flow channel. Herein, the cross-sectional area refers to the surface area (average cross-sectional area) of a flow channel plane orthogonal to the primary flow direction of the liquid.

In addition, in the liquid ejection head, liquid flows from the first flow channel to the downstream second flow channel, passes through a common liquid chamber, and is supplied to individual ejection ports.

Figure 1:
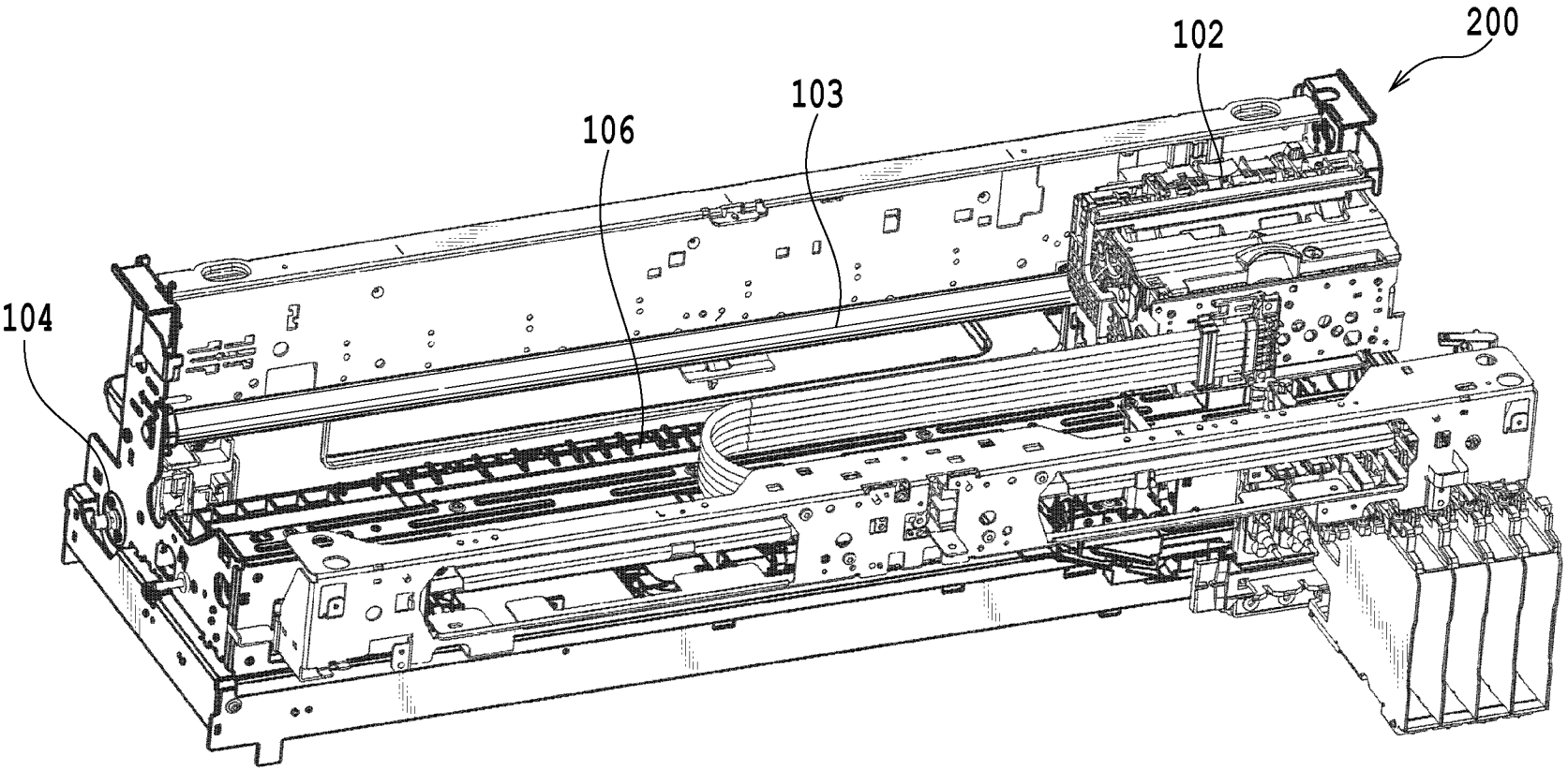
FIG. 1 is a perspective view illustrating a liquid ejection apparatus.

FIG. 1 is a perspective view illustrating a liquid ejection apparatus 200 to which the present embodiment is applicable. A carriage 102 carrying a liquid ejection head is movably supported on a guide 103 extending along a main scanning direction, the carriage 102 being able to move back and forth along the guide 103. The carriage 102 is connected to liquid supply tubes, and is driven by a carriage motor (not illustrated). A print medium such as a sheet of paper is fed by a feed roller (not illustrated) driven by a feed motor of a feed mechanism (not illustrated) via a gear train, and is delivered onto a platen 106 by a transport roller 104 and a pinch roller (not illustrated). Printing is conducted by ejecting liquid from ejection ports of the liquid ejection head onto the print medium transported on the platen 106 by the transport roller 104 and a delivery roller (not illustrated).

When printing onto the print medium, the carriage 102 accelerates from a stopped state, and then moves at a constant speed through the scanning range of the print operation. At this point, liquid is ejected from the ejection ports of the liquid ejection head onto the print medium to form an image. After printing for one line is finished by scanning one or multiple times, the carriage 102 decelerates and stops. Subsequently, the print medium is fed a designated amount by the rotation of the transport roller 104 and the delivery roller.

Figure 2A:
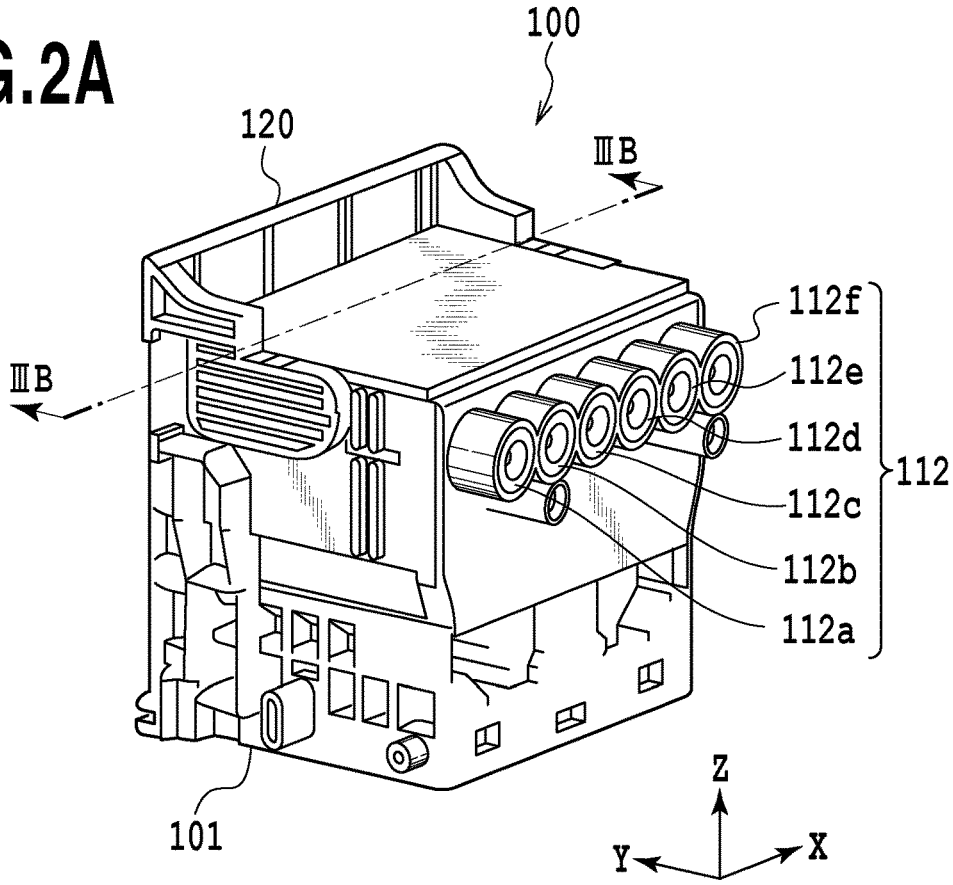
FIG. 2A is a perspective view illustrating a liquid ejection head.
Figure 2B:
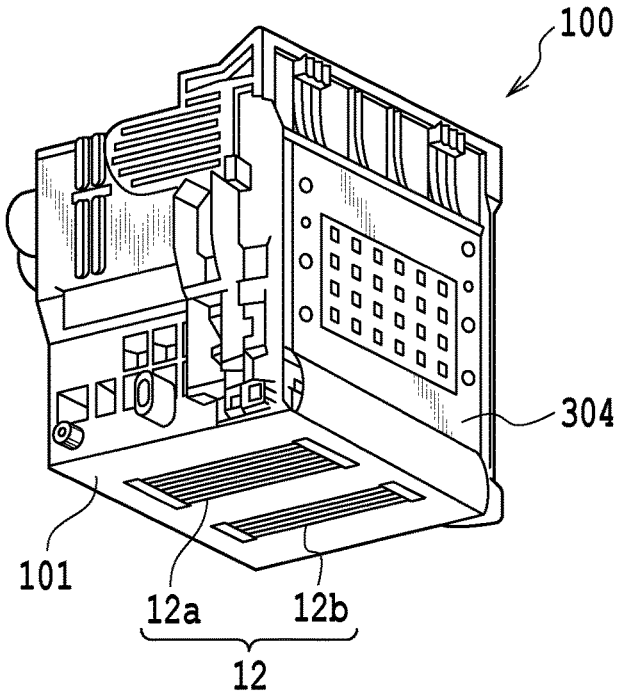
FIG. 2B is a perspective view illustrating a liquid ejection head.

FIGS. 2A and 2B are perspective views illustrating a liquid ejection head 100 to which the present embodiment is applicable. The liquid ejection head 100 is equipped with a liquid supply unit 120, and an ejection element unit 101 for receiving a supply of liquid from the liquid supply unit 120 and ejecting the liquid onto the print medium. The liquid ejection head 100 is affixed to and supported on the carriage 102 by positioning means of the carriage 102 provided in the liquid ejection apparatus 200, and in addition, is removable from the carriage 102. In an ejection element unit 101, two ejection element boards 12 (12*a* and 12*b*) are mounted on a support member 303, and during ejection, a signal is transmitted to each ejection element board 12 from an electrical interconnect board 304.

In the liquid ejection apparatus 200, liquid supply tubes connected to liquid tanks (not illustrated) are provided, and connectors (not illustrated) are provided on the ends of the liquid supply tubes. When the liquid ejection head 100 is mounted onto the carriage 102, an airtight connection is made between the connectors and connector insertion ports 112, and liquid inside the liquid tanks is supplied to the liquid ejection head 100. Six types of liquid may be mounted onto the liquid ejection head 100, and connector insertion ports 112*a* to 112*f* are provided in correspondence with each of the liquid supply tubes to form individual flow channels.

Liquids supplied from the connector insertion ports 112*a* to 112*c* pass through individual flow channels and are supplied to individual liquid chambers on the ejection element board 12*a*. Liquids supplied from the connector insertion ports 112*d* to 112*f* pass through individual flow channels and are supplied to individual liquid chambers on the ejection element board 12*b*.

The ejection element boards 12*a* and 12*b* are equipped with energy-producing elements that produce energy used to eject liquid on one side of a silicon board having a thickness from 0.5 mm to 1 mm. In the present embodiment, heaters are used as the energy-producing elements, and electrical interconnects that supply power to each heater are formed by deposition technology. Additionally, multiple liquid flow channels and multiple nozzles corresponding to these heaters are formed by photolithography, while in addition, liquid chambers (not illustrated) for supplying liquid to the multiple liquid flow channels are formed to open on the back face.

Figure 3A:
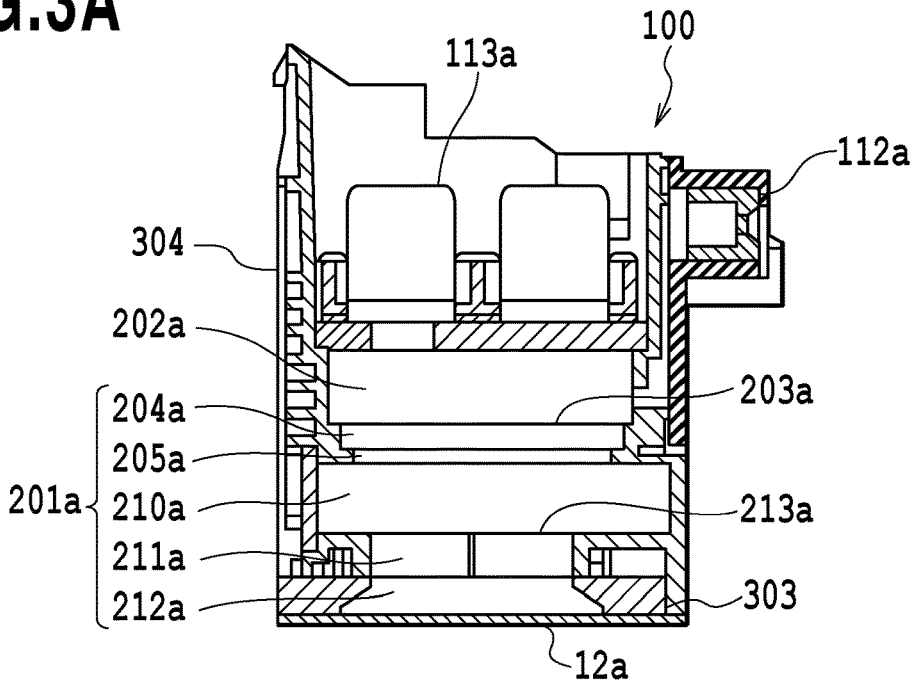
FIG. 3A is a cross-section view illustrating liquid flow channels inside a liquid supply unit.
Figure 3B:
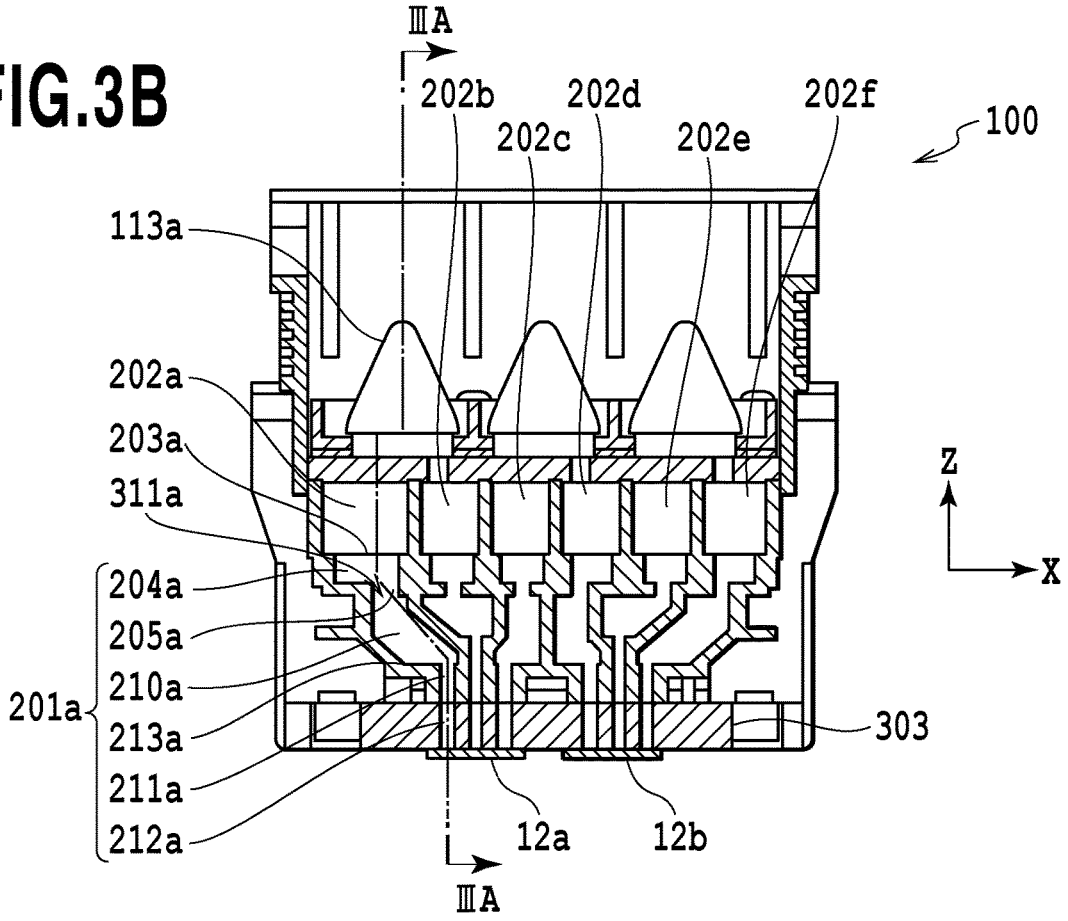
FIG. 3B is a cross-section view illustrating liquid flow channels inside a liquid supply unit.

FIGS. 3A and 3B are cross-section views illustrating respective liquid flow channels inside the liquid supply unit 120, in which FIG. 3B is a cross-section along the line IIIB in FIG. 2A, and FIG. 3A is a cross-section along the line IIIA in FIG. 3B.

Herein, the liquid supply system 311*a* including the connector insertion port 112*a* will be described primarily, but the five other liquid supply systems have a similar structure. Liquid supplied from the connector insertion port 112*a* is supplied by the liquid supply system 311*a* in communication with the connector insertion port 112*a*. Specifically, liquid passes through a filter pre-chamber 202*a*, a filter 203*a* that prevents the intrusion of foreign substances into the ejection element board 12*a*, a filter post-chamber 204*a*, and a filter chamber outlet 205*a*, and is supplied to the ejection element board 12*a* through a first flow channel 210*a*, a second flow channel 211*a* (second upstream flow channel), and a second flow channel 212*a* (second downstream flow channel).

One end of the second flow channel 211*a* is connected to the first flow channel 210*a*, while the other end is connected to the second flow channel 212*a*. The cross-sectional area of the second downstream flow channel 212*a* provided in the support member 303 is greater than the cross-sectional area of the second upstream flow channel 211*a*. A damper apparatus 113*a* in the upper section of the filter pre-chamber 202*a* absorbs pressure variations inside the liquid supply system during ejection.

The flow channel up to the second flow channel 211*a* is provided in the liquid supply unit 120, while the second flow channel 211*a* and the second flow channel 212*a* of approximately the same shape are provided in the support member 303. Consequently, a liquid supply system from the filter 203*a* to the ejection element board 12*a* is formed. Particularly, the pathway from the filter post-chamber 204*a* up to the second flow channel 212*a* constitutes a main flow channel 201*a* in which ejection bubbles produced during ejection, and flow channel bubbles formed by the union of ejection bubbles, move and accumulate.

As shown in FIG. 3B, the second flow channel 211*a* has a smaller cross-sectional area than the first flow channel 210*a*, and has the smallest cross-sectional area in the main flow channel 201*a*. The two are connected by an irregular flow channel connecting section 213*a*. The upstream section of the main flow channel 201*a* has an increased cross-sectional area to decrease the pressure loss of the filter 203*a* due to liquid flow. For this reason, the filter arrangement is provided at the maximum interval allowed by the width of the liquid supply unit 120 in the X direction. The downstream side of the main flow channel 201*a* has a decreased cross-sectional area, and by bringing the flow channels close together, a more compact ejection element board 12*a* is realized.

The arrangement interval of the adjacent second flow channels is approximately the same as the interval of the liquid chambers of the ejection element board 12*a*, and in the liquid supply system, the second flow channel 211*a* farther downstream than the irregular flow channel connecting section 213*a* has the smallest cross-sectional area. Also, by increasing the volume on the upstream side of the main flow channel 201*a*, a larger amount of ejection bubbles may accumulate without interfering with liquid supply. This is also effective at reducing the frequency of purge operations to discharge the bubbles inside the flow channels that increase with ejection.

The irregular flow channel connecting section 213*a* is the downstream end of the first flow channel 210*a*. Here, at the bottom of the first flow channel 210*a*, an inlet of the second flow channel 211*a* having a slot-shaped hole shape smaller than the face of the floor opens out, in a so-called "landing" structure.

Figure 4A:
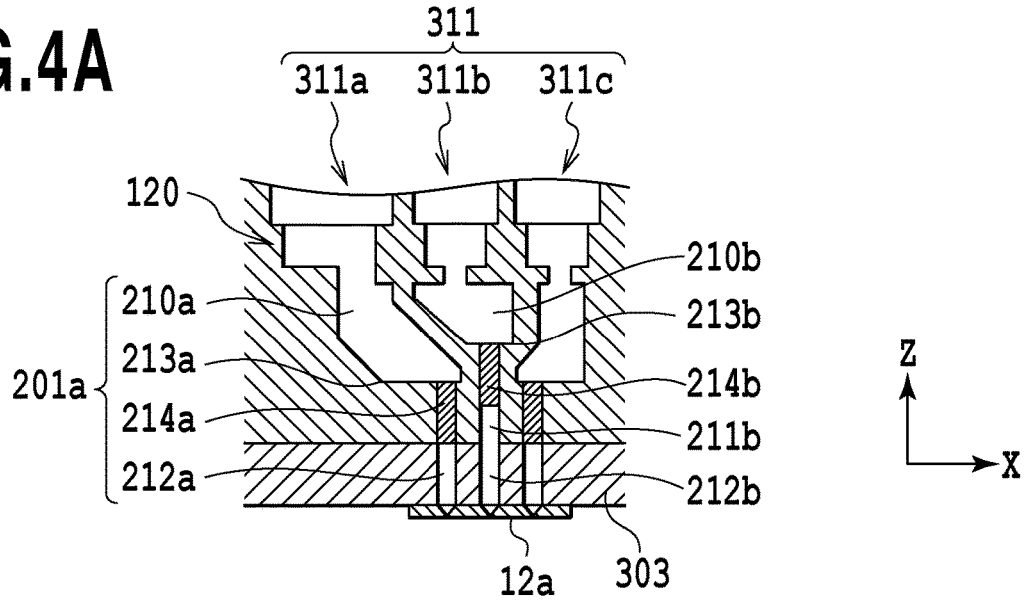
FIG. 4A is a cross-section view illustrating a main flow channel.
Figure 4B:
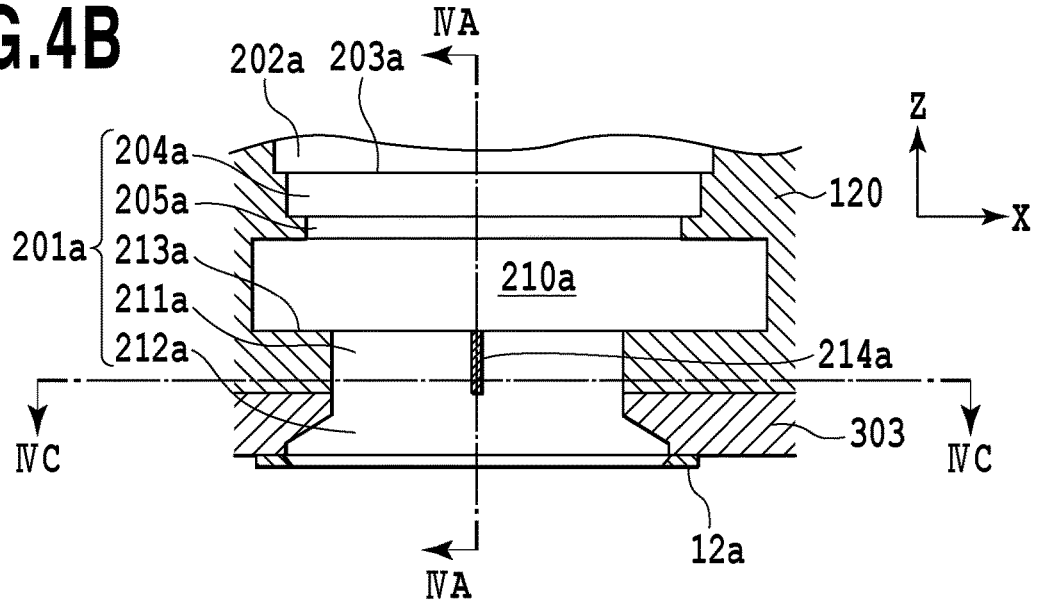
FIG. 4B is a cross-section view illustrating a main flow channel.
Figure 4C:
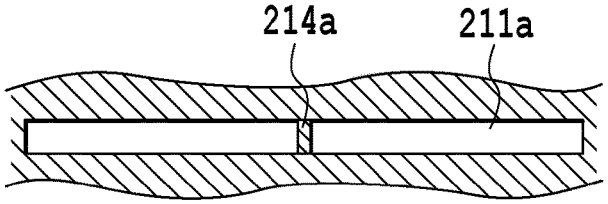
FIG. 4C is a cross-section view illustrating a main flow channel.

FIGS. 4A, 4B, and 4C are cross-section views illustrating the main flow channel 201*a*. FIG. 4A is a cross-section along the line IVA in FIG. 4B, while FIG. 4C is a cross-section along the line IVC in FIG. 4B.

In the main flow channel 201*a* of the liquid ejection head 100 according to the present embodiment, near the center in the Y direction of the second flow channel 211*a*, a projecting member 214*a* originating from the irregular flow channel connecting section 213*a* so as to divide the second flow channel 211*a* in half is provided. The adjacent second flow channels 211*b* and 211*c* are also provided with similar projecting members 214*b* and 214*c*. The projecting member 214*a* is a beam-like member that originates from the irregular flow channel connecting section 213*a*, or in other words the inlet of the second flow channel 211*a*, projects out from the inner side face of the second flow channel 211*a*, and goes across the second flow channel 211*a*.

Note that the flow resistance in the second flow channel 211*a* increases due to the projecting member 214*a*. To equalize this increase in flow resistance, the projecting members in the other adjacent second flow channels are made to have approximately the same length in the Z direction. By providing the projecting member 214*a*, the intrusion of flow channel bubbles into the second flow channel may be prevented, even when a large amount of liquid flows.

FIGS. 5A to 5D are cross-section views illustrating the main flow channel 201*b* in the liquid supply system 311*b* (see FIG. 4A). Herein, the liquid supply system 311*b* will be taken as an example to describe the effect on flow channel bubbles of the projecting member 214*b* in the main flow channel 201*b*.

A flow channel bubble 300 remaining in the upper section of the main flow channel 201*b* due to the filter 203*b* in the upper section of the filter post-chamber 204*b* is the combination of the air in the unfilled volume when filling the flow channel with liquid as part of a purge operation, and ejection bubbles 301 produced near the ejection ports during ejection. During ejection, the ejection bubbles 301 are released from the vicinity of the ejection ports, float up inside the flow channels in communication with the liquid chambers due to the buoyancy of the ejection bubbles 301 themselves, and reach the upper section of the main flow channel 201*b*. A large number of ejection bubbles 301 reaching the upper section unite with the flow channel bubble 300 in the upper section of the main flow channel 201*b*, and the flow channel bubble 300 gradually grows in size.

Since a liquid meniscus is formed on the filter 203*b*, air is unable to escape to the filter pre-chamber 202*b*, and as the flow channel bubble 300 grows, the ratio of the main flow channel 201*b* occupied by the flow channel bubble 300 increases while the amount of liquid in the main flow channel 201*b* decreases.

The size of the flow channel bubble 300 is estimated from the cumulative number of ejections, and when the cumulative number exceeds a designated value, ejection is paused, and the flow channel bubble 300 is discharged by a purge operation. If the flow channel bubble 300 is small, liquid supplied from the filter 203*b* side flows around the flow channel bubble 300, and the flow channel bubble 300 does not move downstream much. However, if the flow channel bubble 300 grows large enough to cover the cross-section of the first flow channel 210*b*, the flow channel bubble 300 moves downstream together with the flow of supplied liquid (see FIG. 5B).

Figure 5A:
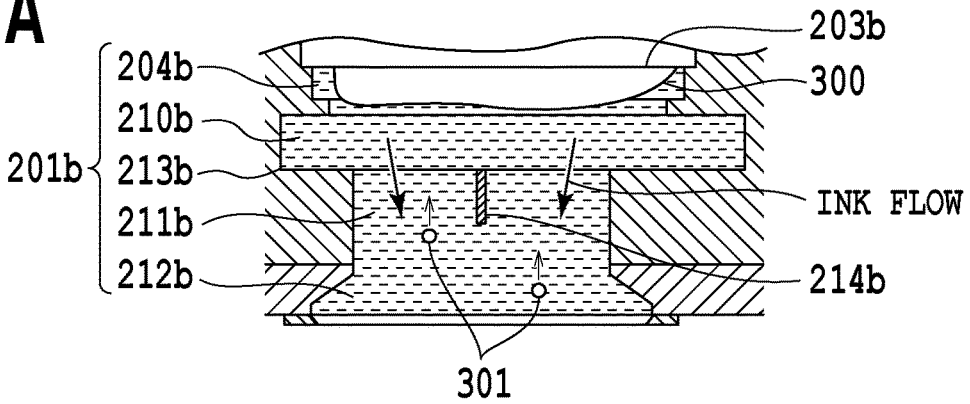
FIG. 5A is a cross-section view illustrating a main flow channel in a liquid supply system.
Figure 5B:
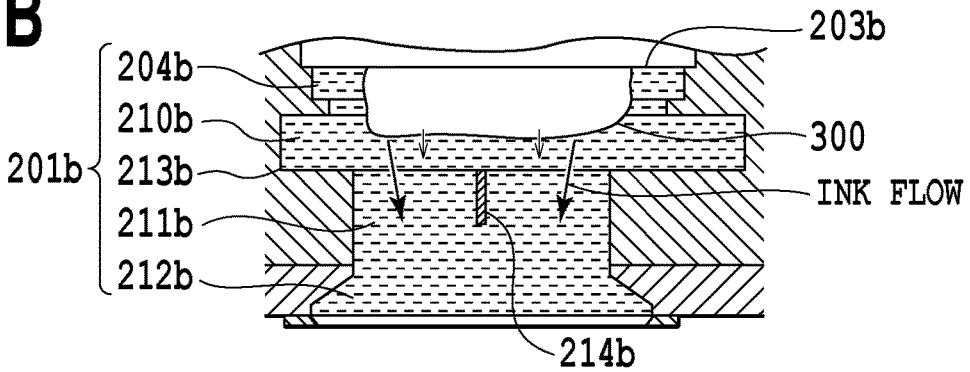
FIG. 5B is a cross-section view illustrating a main flow channel in a liquid supply system.
Figure 5C:
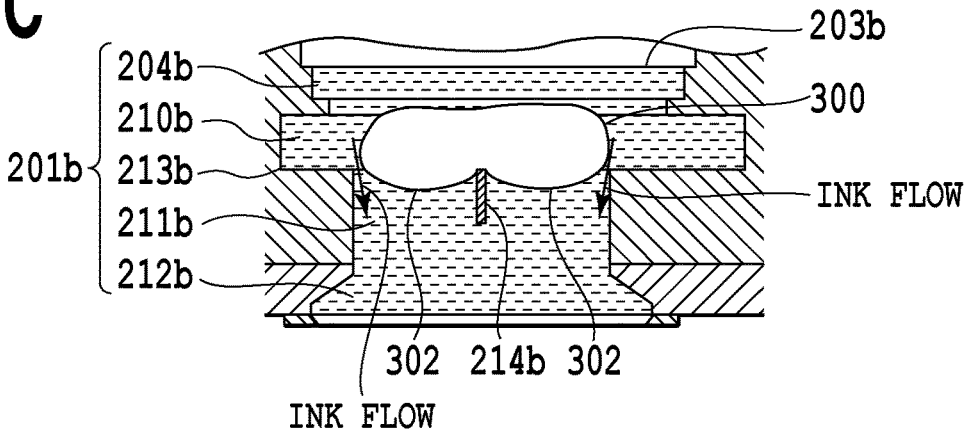
FIG. 5C is a cross-section view illustrating a main flow channel in a liquid supply system.
Figure 5D:
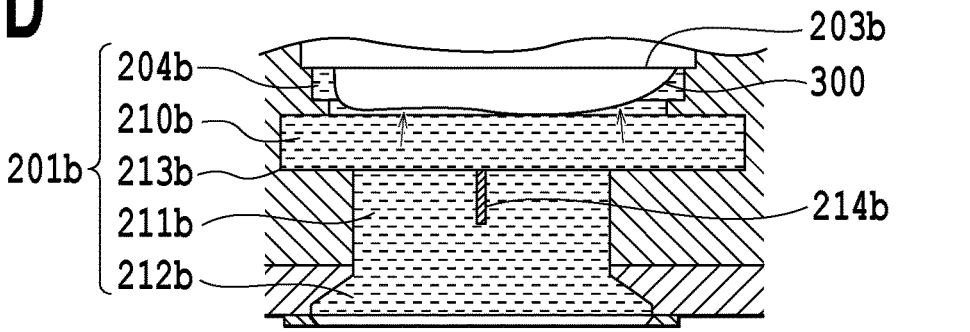
FIG. 5D is a cross-section view illustrating a main flow channel in a liquid supply system.

Since the force imparted by the flow of liquid also increases as the flow channel bubble 300 grows, as the flow of liquid becomes stronger, part of the flow channel bubble 300 enters the second flow channel 211*b* (see FIG. 5C).

However, in the present embodiment, the projecting member 214*b* is provided from the beginning section of the second flow channel 211*b*. Thus, the flow channel bubble 300 attempting to enter the second flow channel 211*b* abuts the projecting member 214*b*, the projecting member 214*ab* deforms the meniscus 302 of the flow channel bubble 300 into a concave shape, and the curvature of the flow channel bubble 300 increases. As the curvature increases, the flow channel bubble 300 deforms less readily, and attempts to maintain the current shape. Consequently, the entry of the flow channel bubble 300 into the second flow channel 211*b* is inhibited. Note that at this time, liquid passes around the flow channel bubble 300 and is supplied downstream.

If ejection stops, the flow channel bubble 300 floats up again (see FIG. 5D), and returns to above the first flow channel 210*b*.

In this way, the projecting member 214*b* is able to prevent the intrusion of the flow channel bubble 300 into the second flow channel with almost no change in the cross-sectional area of the inlet of the second flow channel 211*b*, or in other words, without significantly increasing the flow resistance.

Figure 6A:
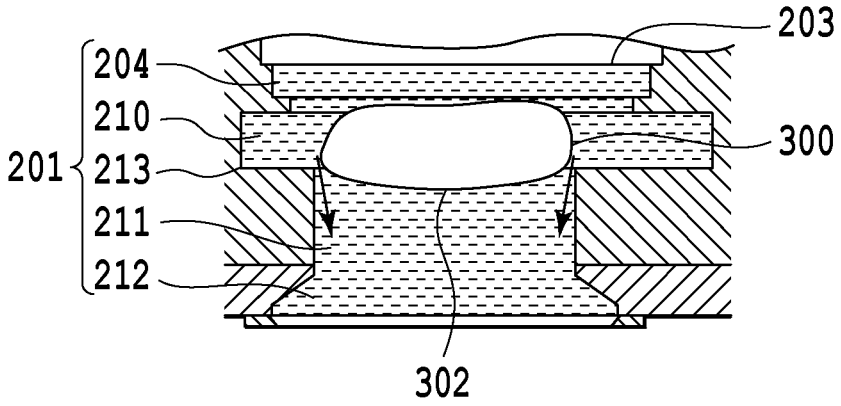
FIG. 6A is a cross-section view illustrating a liquid supply system not provided with a projecting member as a comparative example.
Figure 6B:
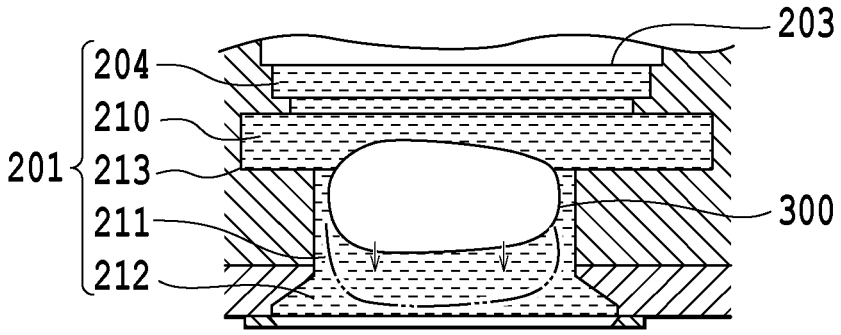
FIG. 6B is a cross-section view illustrating a liquid supply system not provided with a projecting member as a comparative example.

FIGS. 6A and 6B are cross-section views illustrating a liquid supply system not provided with a projecting member as a comparative example. If a projecting member is not provided like in FIGS. 6A and 6B, the meniscus 302 of the flow channel bubble 300 intruding into the second flow channel 211 has a comparatively small curvature (see FIG. 6A). For this reason, compared to the case of providing the projecting member 214*a*, the flow channel bubble 300 disengages with comparatively little force, and intrudes into the second flow channel 211. If the flow channel bubble 300 intrudes into and obstructs the second flow channel 211, negative pressure increases suddenly, the flow channel bubble 300 flows even farther downstream (see FIG. 6B), passes through the second flow channel 212 to reach the ejection element board 12 as indicated by the dashed line, and causes ejection malfunction. In this way, if a projecting member is not provided, the flow channel bubble 300 is able to intrude into the second flow channel 211*a* easily, and may potentially cause ejection malfunction.

Note that as an incidental effect of the present embodiment, the configuration of the present embodiment allows for a larger amount of flow channel bubbles to be accumulated. In other words, it becomes possible to decrease the frequency of the purge operation for discharging flow channel bubbles, improve the utilization rate of the liquid ejection apparatus, and reduce waste liquid due to purge operations.

In this way, in the connecting section where the first flow channel and the second flow channel connect, a projecting member is provided on the flow channel wall forming the second flow channel. Consequently, a liquid ejection head and a liquid ejection apparatus capable of reducing the occurrence of ejection malfunction may be realized.

Second Embodiment

Hereinafter, a second embodiment of the present invention will be described with reference to the drawings. Note that since the basic configuration of the present embodiment is similar to the first configuration, only the characteristic parts of the configuration will be described hereinafter.

Figure 7A:
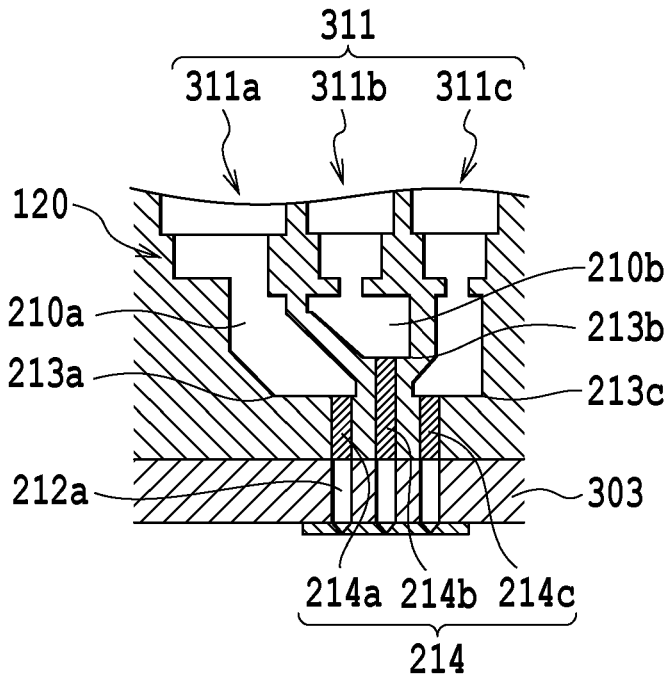
FIG. 7A is a cross-section view illustrating a main flow channel in a liquid supply system.
Figure 7B:
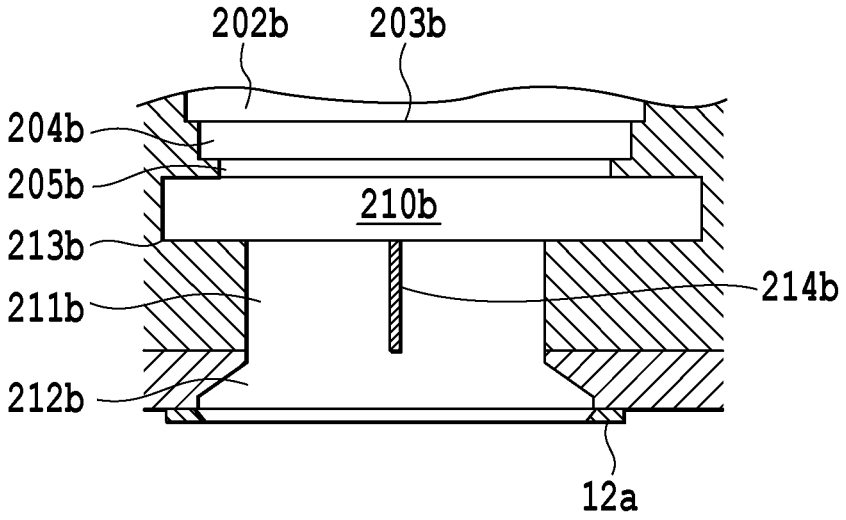
FIG. 7B is a cross-section view illustrating a main flow channel in a liquid supply system.

FIGS. 7A and 7B are cross-section views illustrating the main flow channel 201 in the liquid supply system 311 of the present embodiment. In the present embodiment, the projecting member 214 extends from the irregular flow channel connecting section 213 to the downstream side of the second flow channel 211. With such a configuration of extending to the downstream end of the second flow channel 211, the risk of a flow channel bubble covering a small projecting member 214 and substantially invalidating the advantageous effects of the projecting member 214 may be avoided.

Note that in the case of fabricating the liquid supply unit 120 by plastic molding, there is a risk that a narrow slot-shaped flow channel like the second flow channel of the present embodiment may deform due to shrinkage of the plastic. Specifically, the central area of the slot-shaped cross-section may become narrow and deform into an hourglass shape. In the extreme case, the central area may collapse and impede liquid supply capability. Such deformation of plastic molded components occurs more readily as the length in the Y direction of the ejection element board becomes larger.

According to a structure like the present embodiment, in which a projecting member for restricting the behavior of a flow channel bubble extends to the downstream end of the second flow channel of the liquid supply unit 120, the projecting member also acts as a reinforcing member that prevents deformation of the second flow channel. For this reason, such a structure is effective in the case of mounting an ejection element board that is long in the Y direction.

Note that the projecting member 214 may also be provided up to the second flow channel 212 where the support member 303 is provided.

In this way, in the connecting section where the first flow channel and the second flow channel connect, a projecting member that extends to the downstream end of the second flow channel is provided on the flow channel wall forming the second flow channel. Consequently, a liquid ejection head and a liquid ejection apparatus capable of reducing the occurrence of ejection malfunction may be realized.

Third Embodiment

Hereinafter, a third embodiment of the present invention will be described with reference to the drawings. Note that since the basic configuration of the present embodiment is similar to the first configuration, only the characteristic parts of the configuration will be described hereinafter.

Figure 8:
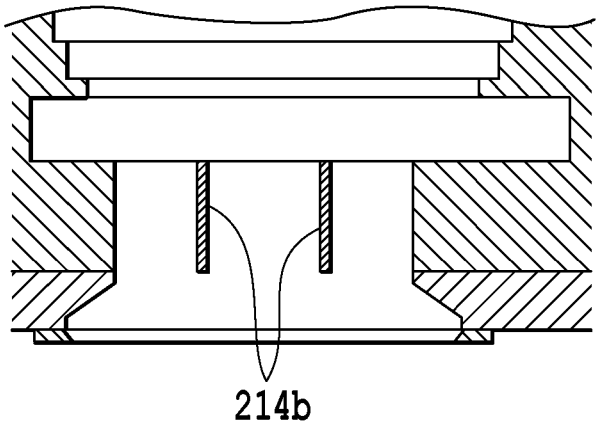
FIG. 8 is a cross-section view illustrating a main flow channel in a liquid supply system.

FIG. 8 is a cross-section view illustrating the main flow channel 201 in the liquid supply system 311 of the present embodiment. Although the foregoing embodiments describe a configuration in which one projecting member is provided in the second flow channel, the present embodiment describes a configuration in which multiple projecting members are provided in the second flow channel.

In the second flow channel of the liquid ejection head 100 according to the present embodiment, two projecting members 214 are provided. However, the number of projecting members is not limited to two, and two or more projecting members may be provided. The projecting members 214 are provided so as to approximately trisect the second flow channel 211 in the Y direction. The projecting members 214 originate near the irregular flow channel connecting section, and extend to the downstream end of the second flow channel 211.

In this way, in the connecting section where the first flow channel and the second flow channel connect, multiple projecting members are provided on the flow channel wall forming the second flow channel. Consequently, a liquid ejection head and a liquid ejection apparatus capable of reducing the occurrence of ejection malfunction may be realized.

Fourth Embodiment

Hereinafter, a fourth embodiment of the present invention will be described with reference to the drawings. Note that since the basic configuration of the present embodiment is similar to the first configuration, only the characteristic parts of the configuration will be described hereinafter.

Figure 9:
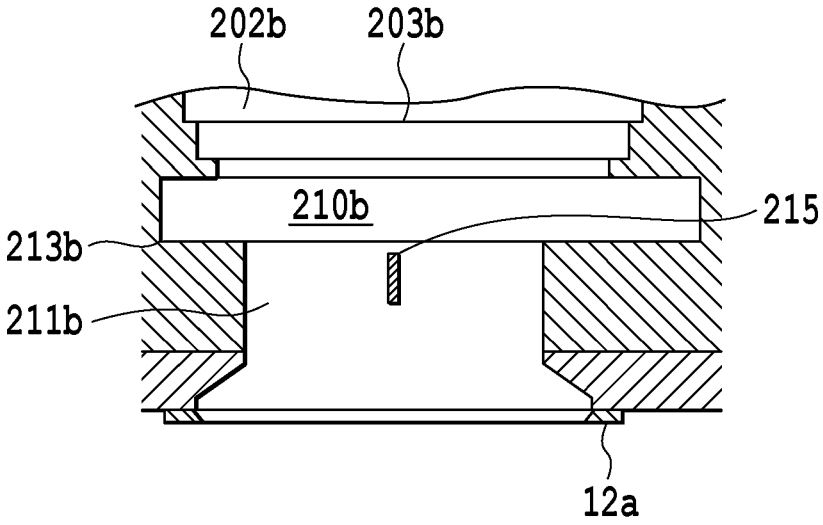
FIG. 9 is a cross-section view illustrating a main flow channel in a liquid supply system.

FIG. 9 is a cross-section view illustrating the main flow channel 201 in the liquid supply system 311 of the present embodiment. The origin of the projecting member 215 according to the present embodiment is provided at a point farther downstream than the irregular flow channel connecting section 213*b*. The origin of the projecting member 215 may be provided in the second flow channel farther downstream than the irregular flow channel connecting section insofar as a flow channel bubble contacts the projecting member before the flow channel bubble flows into the second flow channel, and the projecting member causes the flow channel bubble to deform.

In this way, in the connecting section where the first flow channel and the second flow channel connect, a projecting member originating farther downstream than the irregular flow channel connecting section is provided on the flow channel wall forming the second flow channel. Consequently, a liquid ejection head and a liquid ejection apparatus capable of reducing the occurrence of ejection malfunction may be realized.

Fifth Embodiment

Hereinafter, a fifth embodiment of the present invention will be described with reference to the drawings. Note that since the basic configuration of the present embodiment is similar to the first configuration, only the characteristic parts of the configuration will be described hereinafter.

Figure 10:
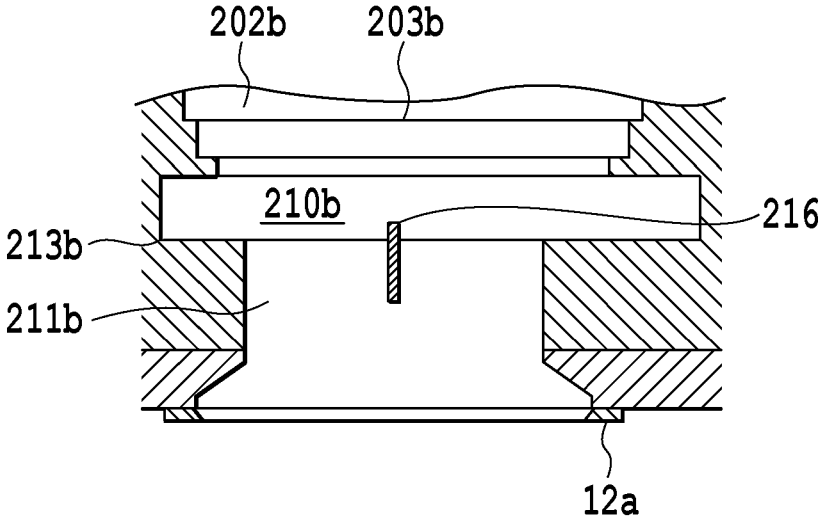
FIG. 10 is a cross-section view illustrating a main flow channel in a liquid supply system.

FIG. 10 is a cross-section view illustrating the main flow channel 201 in the liquid supply system 311 of the present embodiment. The origin of the projecting member 216 according to the present embodiment is provided farther upstream than the irregular flow channel connecting section 213*b*. In other words, the projecting member 216 is provided projecting towards the first flow channel. The origin of the projecting member 216 may be provided farther upstream than the irregular flow channel connecting section insofar as a flow channel bubble contacts the projecting member before the flow channel bubble flows into the second flow channel, and the projecting member causes the flow channel bubble to deform.

In this way, in the connecting section where the first flow channel and the second flow channel connect, a projecting member originating farther upstream than the irregular flow channel connecting section is provided on the flow channel wall forming the second flow channel. Consequently, a liquid ejection head and a liquid ejection apparatus capable of reducing the occurrence of ejection malfunction may be realized.

Other Embodiments

Figure 11A:
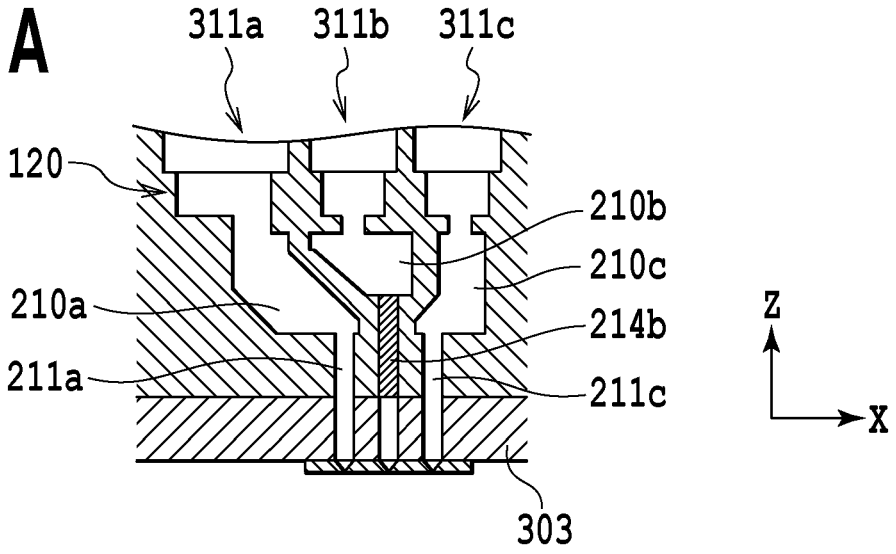
FIG. 11A is a cross-section view illustrating a main flow channel in a liquid supply system.
Figure 11B:
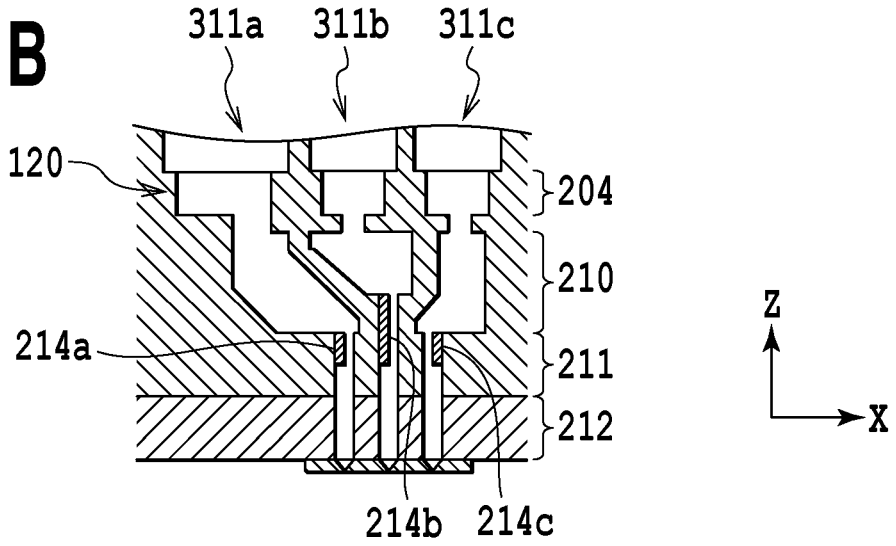
FIG. 11B is a cross-section view illustrating a main flow channel in a liquid supply system.
Figure 11C:
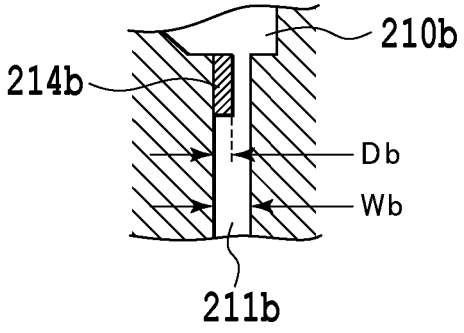
FIG. 11C is a cross-section view illustrating a main flow channel in a liquid supply system.

FIGS. 11A to 11C are cross-section views illustrating the main flow channel 201 in the liquid supply system 311 according to other embodiments. The projecting member may be provided only in some of the liquid supply systems, or the shape of the projecting member, the location where the projecting member is placed, and the number of the projecting member may be modified to fit the characteristics of the individual liquid supply systems. For example, as the volume of the first flow channel becomes smaller, the flow channel bubble reaches the irregular flow channel connecting section more easily, and the amount of flow channel bubbles that may be accumulated becomes smaller.

In FIG. 11A, the projecting member 214*b* is provided only in the second flow channel 211*b* of the liquid supply system (311*b*) in which the position in the Z direction of the irregular flow channel connecting section 213 is high and the volume of the first flow channel 210 is comparatively small. In this way, the projecting member may be provided only in the second flow channel of a liquid supply system in which a flow bubble is considered to reach the irregular flow channel connecting section easily and intrude into the second flow channel easily.

In addition, to decrease flow resistance caused by the projecting member, the projecting member may also not completely extend across the second flow channel. FIGS. 11B and 11C are examples in which the projecting member extending from the inner side face of the second flow channel does not completely extend across the second flow channel. The supply system illustrated in FIG. 11B is effectively an inclined flow channel structure in which all the filter post-chambers 204 and the second flow channels 211 and 212 immediately above the ejection element board 12 are shifted away from each other in the X direction, and connected by an inclined first flow channel 210.

The projecting member is provided only on the side where the flow channel bubble moves above the first flow channel 210, or in other words the side to which the filter post-chamber 204 is shifted as seen from the second flow channel. Also, FIG. 11C is an enlarged view of the area near the projecting member 214*b* in FIG. 11B. To ensure concave deformation of the flow channel bubble without the flow channel bubble avoiding the projecting member 214*b*, the length Db of the projecting member 214*b* is preferably set to at least 50% of the width Wb of the second flow channel in the X direction, which affects flow resistance the most.

Furthermore, if miniaturization of the liquid supply unit 120 is required, it is not necessary to provide a face orthogonal to the flow of liquid like with the landing structure.

In the above description, the supply system is a flow channel having a slot-shaped cross-section effective at increasing the density of liquid, but may also include a flow channel with a circular cross-section. For example, a flow channel in which a second flow channel of circular cross-section or elliptical cross-section connects to a first flow channel of slot-shaped cross-section, a flow channel in which a second flow channel of slot-shaped cross-section connects to a first flow channel of circular cross-section or elliptical cross-section, or a flow channel in which a first flow channel and a second flow channel both of circular cross-section or elliptical cross-section are connected is also acceptable.

In addition, the configurations of the projecting member according to the foregoing embodiments may also be combined to form the projecting member in each second flow channel.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-104847, filed May 22, 2015, which is hereby incorporated by reference herein in its entirety.

What is claimed is:

1. A liquid ejection head including an ejection element board that ejects liquid, wherein a flow channel that guides liquid to the ejection element board includes a first flow channel, and a second flow channel connected on a downstream side of the first flow channel and having a cross-sectional area smaller than the cross-sectional area of the first flow channel, the liquid ejection head comprising:

at least one projecting member projecting out into the flow channel from a flow channel wall forming the second flow channel, wherein the second flow channel includes a second upstream-side flow channel provided on an upstream side, and a second downstream-side flow channel provided on a downstream side.

2. The liquid ejection head according to claim 1, wherein the flow channel is provided in plural.

3. The liquid ejection head according to claim 1, wherein the projecting member is provided across the second flow channel.

4. The liquid ejection head according to claim 1, wherein the projecting member is provided in plural in the second flow channel.

5. The liquid ejection head according to claim 1, wherein the projecting member extends to a terminal end of the second flow channel in a direction of liquid flow.

6. The liquid ejection head according to claim 1, wherein the projecting member is provided projecting from the second flow channel towards the first flow channel.

7. The liquid ejection head according to claim 1, wherein the projecting member originates from a location farther downstream than a connecting section between the first flow channel and the second flow channel.

8. The liquid ejection head according to claim 1, wherein the projecting member and the flow channel are provided in plural and the projecting members are of equal length in the direction of liquid flow in each flow channel.

9. The liquid ejection head according to claim 1, wherein one end of the second flow channel is in communication with the first flow channel, and the other end is in communication with the ejection element board.

10. The liquid ejection head according to claim 1, wherein the cross-sectional area of the second downstream-side flow channel is greater than the cross-sectional area of the second upstream-side flow channel.

11. The liquid ejection head according to claim 1, wherein the projecting member is provided on a flow channel wall forming the second upstream-side flow channel.

12. A liquid ejection apparatus on which a liquid ejection head including an ejection element board that ejects liquid may be mounted, wherein in the liquid ejection head, a flow channel that guides liquid to the ejection element board includes a first flow channel, and a second flow channel connected on a downstream side of the first flow channel and having a cross-sectional area smaller than the cross-sectional area of the first flow channel, the liquid ejection head comprising:

at least one projecting member projecting out into the flow channel from a flow channel wall forming the second flow channel, wherein the second flow channel includes a second upstream-side flow channel provided on an upstream side, and a second downstream-side flow channel provided on a downstream side.

* * * * *